US005695394A

United States Patent [19]

Buffat et al.

[11] Patent Number: 5,695,394

[45] Date of Patent: Dec. 9, 1997

[54] ABRASIVE GRINDING WHEELS

[75] Inventors: Bernard Buffat, Paris; Patrick Micheletti, Saint-Denis; Michel Bousquet, Chalon sur Saone, all of France

[73] Assignee: Norton S.A., La Courneuve Cedex, France

[21] Appl. No.: 549,818

[22] PCT Filed: Apr. 11, 1995

[86] PCT No.: PCT/FR95/00461

§ 371 Date: Jan. 26, 1996

§ 102(e) Date: Jan. 26, 1996

[87] PCT Pub. No.: WO95/27593

PCT Pub. Date: Oct. 19, 1995

[30] Foreign Application Priority Data

Apr. 12, 1994 [FR] France ..... 94 04303

[51] Int. Cl.[6] ..... B23F 21/03

[52] U.S. Cl. ..... 451/546; 451/544; 451/541; 451/542; 125/15

[58] Field of Search ..... 457/546, 544, 457/541, 542; 51/298, 309; 125/15

[56] References Cited

U.S. PATENT DOCUMENTS

| | | | |
|---|---|---|---|
| 226,066 | 3/1880 | Hart | 451/546 |
| 3,315,418 | 4/1967 | Zawodni et al. | 451/546 |
| 4,149,884 | 4/1979 | Maringer et al. | 75/175.5 |
| 4,350,497 | 9/1982 | Ogman | 451/546 |
| 5,411,010 | 5/1995 | Mummenhoff | 125/15 |

OTHER PUBLICATIONS

Japanes Patent Abstract No. 664, Oct. 1986.
Japanese Patent Abstract No. 216, Aug. 1991.
Japanese Patent Abstract No. 273, Jan. 1988.
Sandpaper Options by Jeanne Huber, Apr. 1996.

*Primary Examiner*—Robert A. Rose
*Assistant Examiner*—George Nguyen
*Attorney, Agent, or Firm*—Oblon, Spivak, McClelland, Maier & Neustadt, P.C.

[57] ABSTRACT

The invention relates to abrasive grinding wheels with an organic binder, comprising a reinforcement in the form of metal fibers. Preferably, those fibers are in the form of "vitreous" metallic ribbons.

The grinding wheels according to the invention are advantageously more durable and more conductive.

15 Claims, 1 Drawing Sheet

ABRASIVE GRINDING WHEELS

BACKGROUND OF THE INVENTION

The invention relates to abrasive grinding wheels, and more precisely to the abrasive grinding wheels with an organic binder, which are employed especially for sharpening, grinding, surfacing, burring or, more generally, the usual different types of machining.

DISCUSSION OF THE BACKGROUND

There are known abrasive grinding wheels consisting of abrasive particles embedded in a matrix based on an organic resin, for example of the phenolic or polyimide resin type. To impart good mechanical behavior to these grinding wheels, the matrix is generally reinforced by means of glass fibers. During grinding operations, the heating of the grinding wheel due to friction can cause the degradation of the organic resin which, at least at the surface, is no longer capable of retaining the abrasive particles. The diameter of the grinding wheel thus decreases little by little until the grinding wheel needs to be replaced.

SUMMARY OF THE INVENTION

The objective of the present invention is abrasive grinding wheels with an organic binder whose life-time is improved.

The subject of the invention is an abrasive grinding wheel including abrasive particles embedded in an organic binder and which additionally comprises a reinforcement in the form of metal fibres.

Bearing in mind their slightly higher cost, metal fibres can be employed together with traditional reinforcing fibres such as glass fibres. On the one hand, the metal reinforcing fibres advantageously replace the glass fibres and impart markedly improved mechanical properties at an equivalent quantity of fibres. On the other hand, this type of reinforcement is a good heat conductor, and this permits good dissipation of heat over the whole volume of the grinding wheel and thus decreases the risks of degradation of the organic substance. Advantageously, furthermore, the electrically conductive nature of the metal reinforcement enables the wear of the wheel to be checked by means of contactless sensors.

DETAILED DESCRIPTION OF THE PREFERRED EMBODIMENTS

Figure 1:
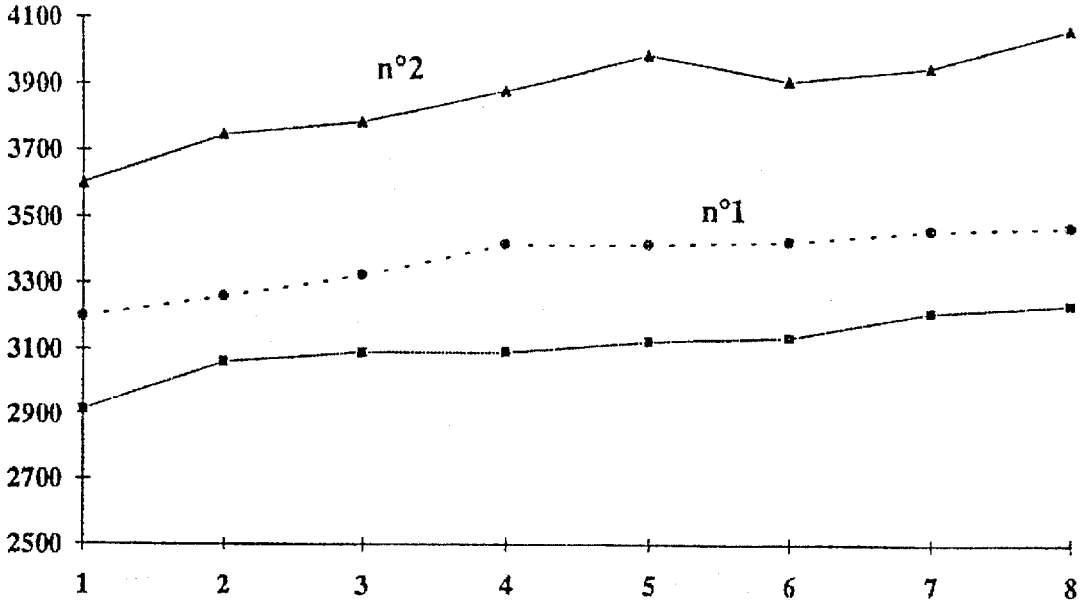

The metal fibres preferably have the following size characteristics: a length of 5 to 10 mm, preferably from 10 to 20 mm. They are advantageously chosen in the form of ribbons which have, in particular, a width of 0.5 to 7 mm, especially from 1 to 5 mm, and a thickness of less than 5/10th of mm, especially of the order of 2 to 3/10th of mm.

These metal fibres or ribbons may be advantageously chosen as metal "glass". This term denotes a metallic material solidified in the vitreous state, which can be obtained especially by a process called hyperquenching. For further details on this technique reference may be made especially to patent FR-2 486 838, corresponding to US patents U.S. Pat. No. 4,520,859 and U.S. Pat. No. 4,562,877. It involves, in fact, abruptly cooling a jet of molten metal leaving an ejection orifice above which there is a band travelling at high speed. Opposite one of the faces of the said band and in the vicinity of the region of impact of the metal or of the alloy or of the molten metal there is at least one caisson comprising at least one ejection orifice for a fluid under pressure, preferably at low temperature, thus creating a fluid cushion between the caisson and the band which maintains the latter frictionlessly on the caisson. When the molten metal or alloy comes into contact with the band it undergoes what is called hyperquenching and it solidifies to form a metal ribbon in the vitreous state.

These amorphous metal ribbons have rather advantageous properties: they are especially particularly ductile and "flexible" while being particularly strong mechanically. Any other quenching process enabling such metal "glasses" to be obtained may, of course, be employed.

The metal glasses employed within the scope of the invention may be based on alloys of the $A_nB_{1-x}$ type where A consists of one or more transition metals (Fe, Cr, Ni, Mn, Co, etc.) and B of one or more metalloids (F, C, Si, B, etc.) and where x, which is the atomic fraction of A, may be especially of the order of 0.8. It may also be, for example, amorphous pig iron.

The metal fibres or ribbons are generally employed in a proportion of a volume of between 1 to 4% of the total volume of the manufactured grinding wheel. The mechanical strength increases with the quantity of the fibres which is employed; however, the volume of the grinding wheel before the press-forming of the mixture and polymerization of the resin also increases, with the result that the moulding and demoulding operations can become critical beyond a certain volume of fibres or ribbons. Very satisfactory results are obtained with a volume of fibres or ribbons representing approximately 1.2% to 4% of the total volume of the manufactured grinding wheel, and more generally of the order of 2 to 3% of the total volume of the grinding wheel.

The organic binder employed for manufacturing the grinding wheels according to the invention is preferably based on phenolic and/or polyimide resins. The abrasive particles which are embedded in this binder are, in a known manner, preferably made of a ceramic material of the alumina type, which may also include a small proportion of impurities or of "dopants", especially traces of metals of the Zr or Fe type.

These abrasive particles advantageously correspond to a volume of 40 to 70% of the total volume of the grinding wheel, especially to approximately 50 to 65% of the said volume. This proportion of particles may, in fact, be modified as a function of the required abrasivity of the grinding wheel.

Similarly, these abrasive particles are grains in the form of particles or small rods, which have a mean diameter (or a length) of 1/10th of mm to 3 mm, especially of approximately 1.5 mm. The grain size will have to be selected as a function of the use of the grinding wheel, especially of the degree of polish of the workpiece to be obtained.

Figure 2:
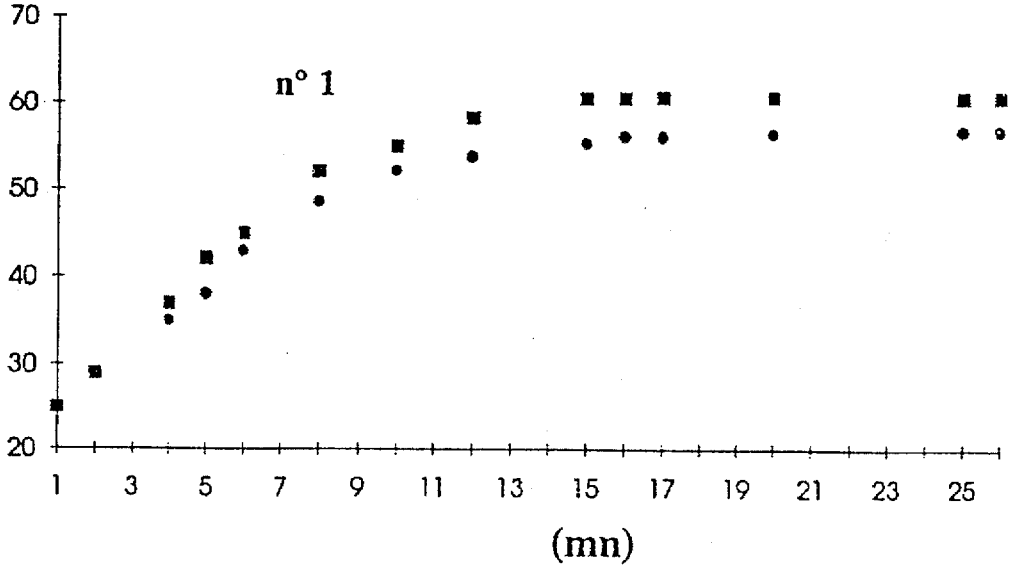

Other details and advantageous characteristics of the invention emerge from the description given below with reference to the attached drawings, which show:

FIG. 1: comparative curves illustrating the mechanical properties of a grinding wheel according to the prior art and of grinding wheels according to the invention, FIG. 2: comparative curves of the thermal conductivity of grinding wheels according to the prior art and according to the invention.

The abrasive grinding wheels with an organic binder are obtained by kneading the grains of abrasive with a binder, in this case a phenolic resin, and a reinforcing fibres or ribbons. The distribution of the reinforcing fibres must be as homogeneous as possible. When the mixture is ready it is weighed and poured into a press mould. The grinding wheel is then taken under a heating press and then into an oven where the resin is polymerized at a temperature of the order to 180° C. for an average period of approximately 24 to 36 hours.

The reinforcing fibres employed are preferably thin metal glass ribbons quenched by casting onto a continuously moving cold substrate—generally a wheel. In this case they are ribbons of amorphous cast iron obtained by hyperquenching, like those that can be obtained by the process described in the abovementioned patents. They have a length of approximately 15 mm, a width of approximately 2 to 3 mm and a thickness of 2 to 3/10th of mm.

The metal ribbons are preferably added in a proportion of a variable fraction of the volume of the manufactured grinding wheel which is between 1 and 4%, as explained in detail later. The volume of the mixture before curing undergoes a relatively high swelling, and this can prevent a few problems when the mould is being filled, before the pressing operation, and subsequently, during the demoulding. This is whey it is preferable to limit the volumes of metal ribbons to not more than 4%. It may additionally be noted that a homogeneous mixture is easier to prepare the smaller the quantity of fibres.

From the viewpoint of the present invention it is important to stress that, in addition, the pressing operation and the long and flat shape of the ribbons exhibiting a sufficiently high length/width ratio result in the preferred alignment of the ribbons in the plane perpendicular to the axis of the grinding wheel. As the grinding wheel works on its cut edge, the radial arrangement of the reinforcing fibres which results therefrom promotes the propagation of heat towards the central part of the grinding wheel, with the result that the heat is dissipated over the whole of the grinding wheel.

The abrasive particles are in this case made of alumina, in the form of grains with a mean diameter of approximately 1.5 mm and are incorporated into the binder in a quantity corresponding to approximately 62% of the total volume of the grinding wheel.

The grinding wheels according to the invention were tested from the viewpoint of their mechanical behavior and their heat behaviour, by comparing the results with those of reference grinding wheels of the same dimensions and identical composition except for the nature of the reinforcing fibres and, possibly, their quantity. The reference grinding wheel comprises 4% by volume of so-called reinforcing glass fibres.

The grinding wheels tested are in the shape of cylindrical rings with an outer diameter of 610 mm, an inner diameter of 203 mm and a height of 76 mm. Grinding wheels of this type are employed at a peripheral speed which is generally between 60 and 80 m/s; however, as a safety measure it is desirable for the bursting speed to be higher than 150 m/s. The reference grinding wheel bursts at 5380 revolutions/minute, that is 171 m/s. A grinding wheel according to the invention with a percentage of metal fibres of 2% bursts at 5000 revolutions/minute, that is a speed of 160 m/s. The grinding wheel according to the invention, containing 4% of metal fibres, withstood a rotation at 5400 revolutions/minute without apparent damage.

The superiority of the mechanical behavior of the grinding wheels according to the invention also emerges very clearly from the following rupture test: a solid cylindrical wheel of 26 mm diameter with a height of 20 mm is clamped, on its cut edge, between two jaws which are tightened until the article breaks. The rupture obtained is, paradoxically, a rupture similar to a tensile rupture and, as a result, is highly significant of the actual behavior of an abrasive grinding wheel. The values of the compression at rupture, measured on a series of 8 test pieces arbitrarily numbered from 1 to 8 for each series are shown in FIG. 1. The first series corresponds to test pieces corresponding to the reference composition, that is a reinforcement with 4% of glass fibres. The other two series, bearing the legend test No. 1 or test No. 2 correspond to compositions according to the invention, that is 1.41% by volume of metal ribbons in the case of test No. 1 and 4% by volume of metal ribbons in the case of test No. 2. The average gain in relation to the reference grinding wheel is 8% in the case of the test series No. 1 and 24% in the case of the test series No. 2.

Furthermore, the heat behaviour of the grinding wheels was tested by placing between two platens of a press, heated to approximately 170° C., a first control rod whose composition corresponds to the reference grinding wheel and a second rod whose composition corresponds to that of the grinding wheel of test No. 1. The temperatures of the rods are measured every minute with the aid of two thermocouples. The values are shown in FIG. 2 (the circles correspond to the temperature of the reference rod and the squares to test No. 1). After a period of approximately a quarter of an hour the temperature of the rods stabilizes at a value of approximately 55°–56° C. in the case of the rod according to the invention. The rod corresponding to a grinding wheel according to the invention therefore heats up significantly more than the rod corresponding to the reference wheel, and this indicates that it has lost a good part of its insulating nature. In addition, it can be seen in this FIG. 2 that the rise in temperature of the rod according to the invention is slightly faster, which is more especially advantageous. The effect of the metallic nature of the ribbons is thus clearly demonstrated.

Furthermore, the quantity of metal present in the grinding wheels according to the invention is sufficiently large to permit continuous monitoring with the aid of contactless sensors, this being, for example, to check systematically the value of the outer diameter of the grinding wheel and hence its state of wear.

Finally, it is important to stress that the grinding wheels according to the invention are not only more robust mechanically but in addition make it possible to raise the quality of the machining of the ground workpieces: the fact that the grinding wheels according to the invention promote fast heat removal prevents the ground workpieces from blackening or being "scorched" by excessive heating.

We claim:

1. An abrasive grinding wheel, comprising:

a) an organic binder;

b) abrasive particles accounting for 40 to 70% of total volume of said wheel embedded in said binder; and c) amorphous metal ribbons as reinforcement materials in said binder accounting for 1 to 4% of the total volume in said wheel, wherein said ribbons have a length of 5 to 30 mm, a width of 0.5 to 7 mm, a rectangular cross-section, and wherein the product of the length and width is between 2.5 and 210 $mm^2$.

2. Grinding wheel according to claim 1, wherein the metal fibers have a length from 10 to 20 mm.

3. Grinding wheel according to claim 1, wherein the metal ribbons have a thickness of less than 5/10th of mm.

4. Grinding wheel according to claim 3, wherein the metal ribbons have a thickness between 2/10 and 3/10th of mm.

5. Grinding wheel according to claim 2, wherein the metal ribbons have a width of 1–5 mm.

6. Grinding wheel according to claim 1, wherein the metal fibers are made of metal glass obtained by hyperquenching a jet of molten metal on a continuously moving substrate.

7. Grinding wheel according to claim 1, wherein the metal fibres are based on amorphous pig iron.

8. Grinding wheel according to claim 1, wherein the metal fibers are added in a proportion of a volume of 2–3% of the total volume of the grinding wheel.

9. Grinding wheel according to claim 1, wherein the organic binder is based on phenolic and/or polyimide resins.

10. Grinding wheel according to claim 1, wherein the abrasive particles are made of ceramic alumina.

11. Grinding wheel according to claim 10, wherein the ceramic alumina contains traces of Zr or Fe metals.

12. Grinding wheel according to claim 1, wherein the abrasive particles correspond to a volume of approximately 50 to 65% of the total volume of the grinding wheel.

13. Grinding wheel according to claim 1, wherein the abrasive particles are grains in the form of particles or small rods, which have a mean diameter of 1/10th of mm to 3 mm.

14. Grinding wheel according to claim 13, wherein the abrasive particles are grains in the form of particles or small rods which have a mean diameter of approximately 1.5 mm.

15. Grinding wheel according to claim 1, wherein the reinforcing metal fibers have a preferred alignment in a plane perpendicular to the axis of the grinding wheel.

* * * * *